US010221003B2

(12) United States Patent
Ayala

(10) Patent No.: US 10,221,003 B2
(45) Date of Patent: Mar. 5, 2019

(54) PACKAGING CORNER PROTECTION SYSTEM

(71) Applicant: Antonio Julio Ayala, Greenfield, CA (US)

(72) Inventor: Antonio Julio Ayala, Greenfield, CA (US)

( * ) Notice: Subject to any disclaimer, the term of this patent is extended or adjusted under 35 U.S.C. 154(b) by 0 days.

(21) Appl. No.: 15/266,637

(22) Filed: Sep. 15, 2016

(65) Prior Publication Data

US 2018/0072479 A1 Mar. 15, 2018

(51) Int. Cl.
*B65D 81/05* (2006.01)

(52) U.S. Cl.
CPC ..... *B65D 81/054* (2013.01)

(58) Field of Classification Search
CPC ..... B65D 81/02; B65D 81/054; B65D 81/06; B65D 85/30
USPC ..... 206/453, 586; D3/408
See application file for complete search history.

(56) References Cited

U.S. PATENT DOCUMENTS

| | | | | | |
|---|---|---|---|---|---|
| 1,865,485 | A | | 7/1932 | Sas | |
| D192,385 | S | * | 3/1962 | Anderson | 206/453 |
| 3,047,142 | A | | 7/1962 | Heffley | |
| 3,049,260 | A | * | 8/1962 | Stone | B65D 81/054 206/586 |
| 3,152,693 | A | * | 10/1964 | Anderson | B65D 71/04 206/453 |
| D225,829 | S | * | 1/1973 | Szabo | D8/403 |
| 4,063,702 | A | | 12/1977 | Wilde et al. | |
| 4,120,441 | A | | 10/1978 | Hurley | |
| 4,202,449 | A | | 5/1980 | Bendt | |
| 4,742,916 | A | | 5/1988 | Galea | |
| D301,953 | S | * | 7/1989 | Evenson | D8/403 |
| 4,877,673 | A | * | 10/1989 | Eckel | B65D 81/054 206/453 |
| 4,938,357 | A | * | 7/1990 | Schmidt | B60P 7/0869 206/453 |
| 5,749,512 | A | * | 5/1998 | Gingras-Taylor | B65D 5/445 206/586 |
| 5,918,800 | A | | 7/1999 | Goshorn et al. | |

(Continued)

FOREIGN PATENT DOCUMENTS

| | | |
|---|---|---|
| ES | 254813 | 10/1981 |
| FR | 2446238 | 8/1980 |
| JP | H09226823 | 9/1997 |

*Primary Examiner* — Bryon Gehman
(74) *Attorney, Agent, or Firm* — Jeffrey G. Sheldon; Katherine B. Sales; Cislo & Thomas LLP

(57) ABSTRACT

A packaging corner protecting device includes an arcuate center portion having a length and having first thickness and formed as 270° of a cylinder more or less. A first arm extends substantially the length of the center portion and has a cross section tapering from the first thickness at a proximate end to a second smaller thickness at a distal end thereof and is integrally joined to the center portion at a first end of the surface of the center portion. A second arm extends substantially the length of the center portion and has a cross section tapering from the first thickness at a proximate end to the second smaller thickness at a distal end thereof and is integrally joined to the center portion at a second end of the surface of the center portion. The arms each have substantially flat inner surfaces that lie in planes intersecting the axis of the center portion.

4 Claims, 3 Drawing Sheets

(56) References Cited

U.S. PATENT DOCUMENTS

| | | | | |
|---|---|---|---|---|
| 8,201,796 | B2 * | 6/2012 | Belyea | A47B 95/043 206/453 |
| 8,844,719 | B2 * | 9/2014 | Yoshida | B65D 81/053 206/453 |
| 2006/0243636 | A1 * | 11/2006 | Robichaud | B65D 81/056 206/586 |

* cited by examiner

PACKAGING CORNER PROTECTION SYSTEM

The present invention relates to cargo transportation. More particularly, the present invention relates to a packaging corner protection system.

BACKGROUND

It is necessary to transport objects having edges with angular, generally right angular cross section, such as containers like boxes and stacks of boxes, cartons or crates, other rectangular objects including but not limited to concrete blocks, bricks, stacks of materials such as gypsum board, plywood, sheet metal, cardboard, paper and other sheet material. These objects are often placed on pallets for transportation.

These objects must be secured during transport, usually by tie-downs such as ropes, cargo straps, or other lashings. Some of these containers or materials have a limited mechanical strength, particularly at their top edges where the ropes cargo straps or other lashings come into contact with and exert large forces on the top edges of these objects. In many cases, deformation of the top edges of these objects will damage the objects or the containers. In addition, where the cargo load consists of numerous small objects such as bricks, blocks, or smaller boxes, it is often necessary to stabilize the load across portions of the top edges of the load to prevent movement of ones of the objects that are not in contact with the tie-downs.

BRIEF DESCRIPTION

A packaging corner protecting device for objects having edges with a generally right angular cross section includes an arcuate center portion having a length and having first thickness and formed as 270° of a cylinder more or less. A first arm extends substantially the length of the cylinder and has a cross section tapering from the first thickness at a proximate end to a second smaller thickness at a distal end thereof. The first arm is integrally joined to the center portion at a first end of the surface of the cylinder. A second arm extends substantially the length of the cylinder and has a cross section tapering from the first thickness at a proximate end to the second smaller thickness at a distal end thereof. The second arm is integrally joined to the center portion at a second end of the surface of the cylinder. The first and second arms each have substantially flat inner surfaces that lie in planes oriented orthogonal to one another that intersect the axis of the cylinder.

During use, the cylindrical shape of the center portion of the protecting device is spaced apart from the top-to-side edge of the object. This ensures that that the load exerted by the tie-downs on the device will be carried by the top and side portions of the object in the regions contacted by the inner surfaces of the first and second arms. Further due to the increased number of bends in the profile the device will have a greater stiffness in its longitudinal direction, which will improve the distribution of the load.

According to one aspect of the invention, the inner surfaces (and optionally the outer surfaces) of the first and second arms include longitudinal ridges to increase gripping the surfaces of the objects being transported. According to other aspects of the invention, the first and second arms are tapered linearly or in steps from their proximate ends to their distal ends.

The protecting device of the present invention may be formed in arbitrary lengths by an extrusion process and may be cut to desired shorter lengths at the time of use.

BRIEF DESCRIPTION OF THE DRAWING FIGURES

The invention will be explained in more detail in the following with reference to embodiments and to the drawing in which are shown:

DETAILED DESCRIPTION

In the following description, numerous specific details are set forth in order to provide a more thorough description of the present invention. It will be apparent, however, to one skilled in the art, that the present invention may be practiced without these specific details. Other embodiments of the invention will readily suggest themselves to such skilled persons having the benefit of this disclosure. In some instances, well-known features have not been described in detail so as not to obscure the invention.

Figure 1:
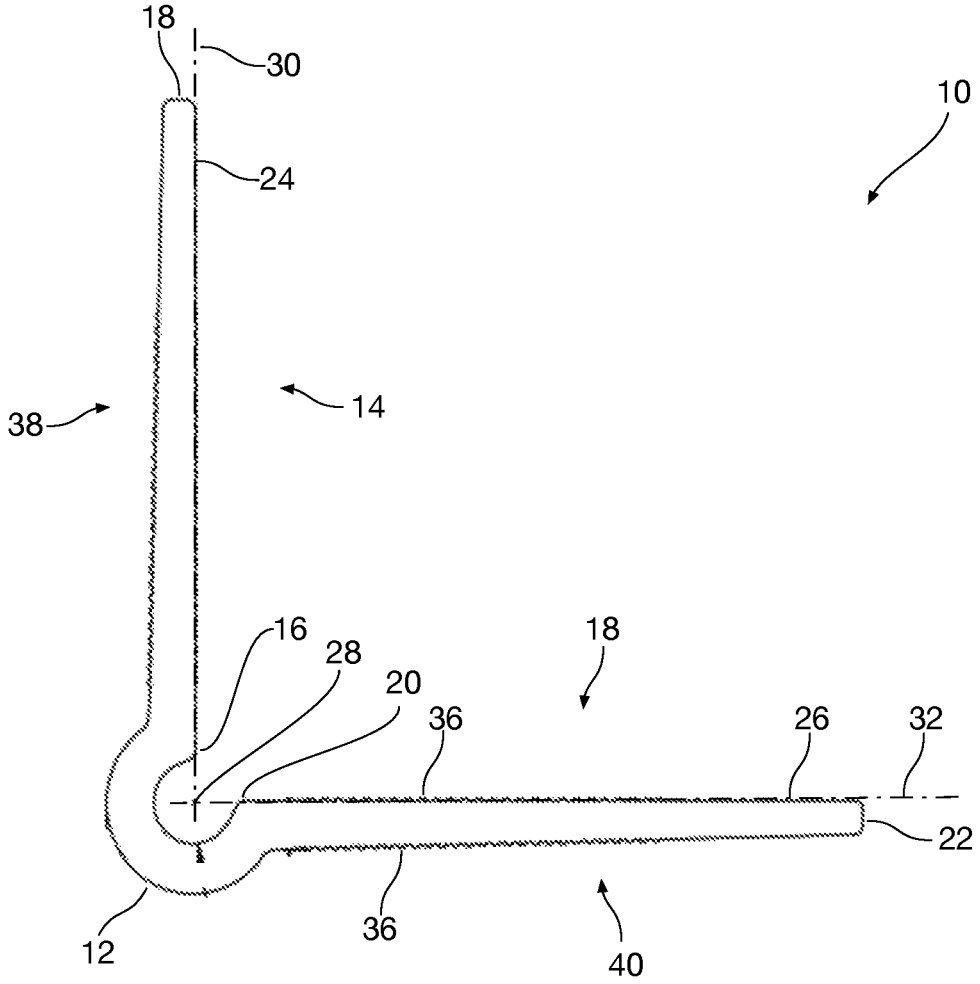
FIG. 1 is a cross sectional view of an exemplary protection device in accordance with the present invention.

Referring first of all to FIG. 1, a cross sectional view shows an exemplary protection device 10 in accordance with the present invention. The protection device 10 may be formed using an extrusion process from materials such as, but not limited to, polyvinyl chloride (PVC), polyetheylene, low-density polyethylene (LDPE) high-density polyethylene (HDPE) or ultra-high-density polyethylene (UHDPE). In some embodiments of the invention, metals such as aluminum or alloys could be employed.

The packaging corner protecting device 10 includes an arcuate center portion 12 having a first thickness and formed as a partial radial section of a cylinder, about 270° more or less. The thickness of the center portion 12 depends somewhat on the application in that embodiments of the invention designed to secure heavier loads should be thicker than embodiments of the invention designed to secure lighter loads. In a typical embodiment, the wall thickness of the cylindrical central portion 12 may be about 0.6875 inch.

A first arm 14 extends from a proximal edge 16 integrally formed at a first edge of the partial cylinder 12 to a distal end 18 and runs substantially the length of the central portion 12. A second arm 18 extends from a proximal edge 20 integrally formed at a first edge of the partial cylinder 12 to a distal end 22 and runs substantially the length of the central portion 12. Inner surfaces 24 and 26, respectively of the first and second arms are substantially planar and each lies in a plane parallel to the axis 28 of the cylindrical axis of the central portion 12 that is coextensive with two radial axes (30, and 32, respectively) of the central portion disposed orthogonally with respect to one another.

Figure 2:
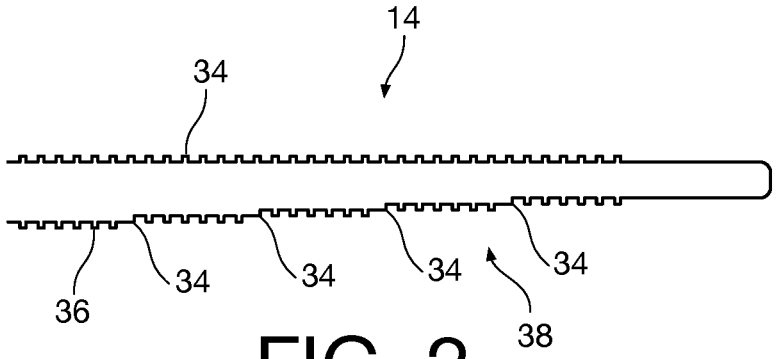
FIG. 2 is a cross sectional view of a portion of one arm of another exemplary protection device in accordance with another aspect of the present invention.
Figure 3:
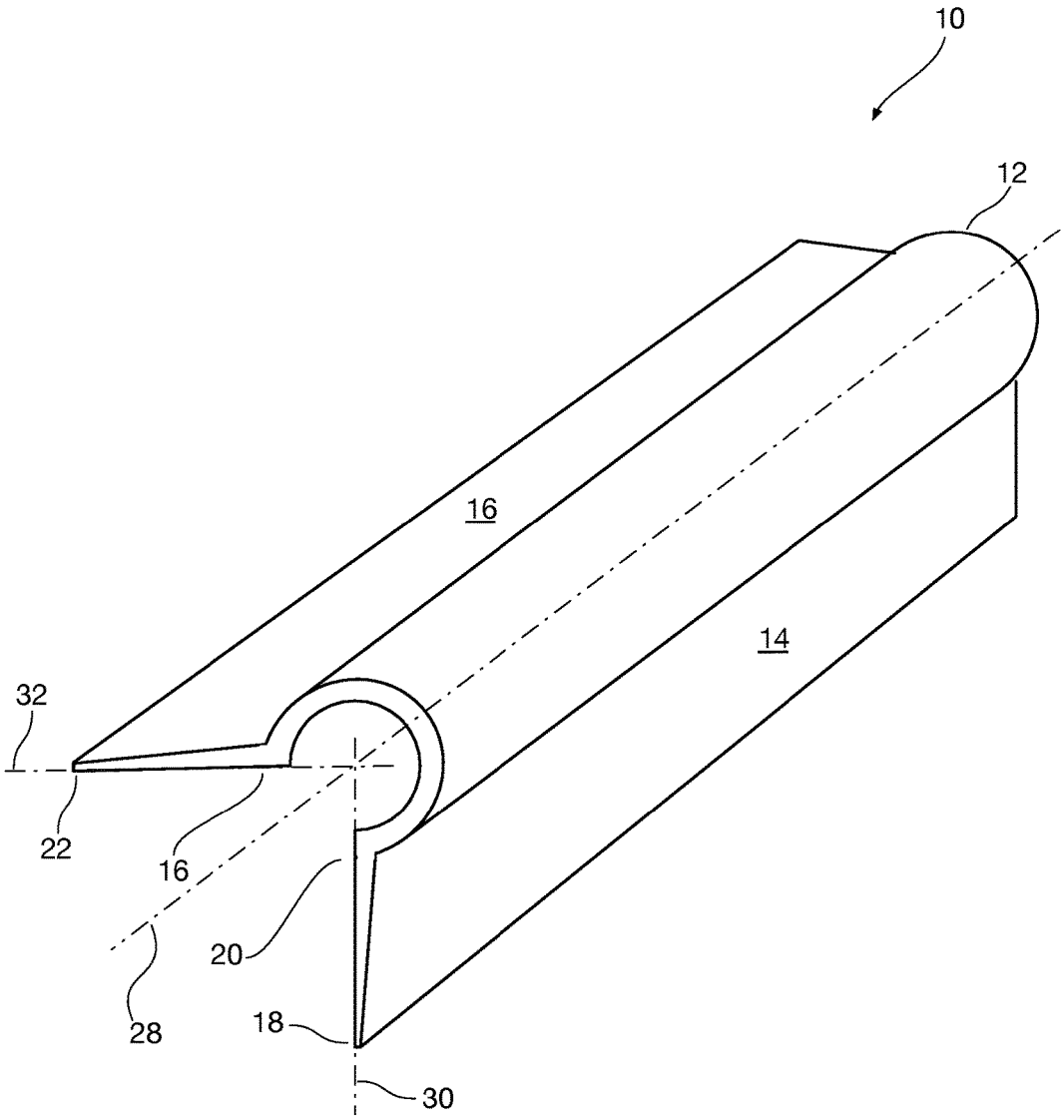
FIG. 3 is an isometric view of an exemplary protection device in accordance with another aspect of the present invention.

The first arm 14 and the second arm 18 both have cross sections that taper from the first thickness at the proximate end 20 to a second smaller thickness at the distal end 22. In an embodiment where the thickness of the central portion 12 is 0.6875 inch more or less, the distal ends of the first and second arms 14 and 18 may taper to 0.250 inch more or less. FIG. 2 shows an exemplary embodiment where the taper is a linear taper. FIG. 2 shows an exemplary embodiment where the taper is a stepped taper, and includes a plurality of steps 34.

According to one aspect of the present invention, both the first and second arms 14 and 18 may extend out the same distance from the central portion 12. In one embodiment, both arms 14 and 18 extend a distance 6 inches more or less from the central portion 12. According to another aspect of the present invention one arm (to extend over the top surface of the object) could be longer than the other arm (to extend over the side surface of the object). In an exemplary non-limiting embodiment, one arm may extend a distance 6 inches more or less from the central portion 12 and the other arm may extend a distance 4 inches more or less from the central portion 12.

According to another aspect of the present invention, the arms may be provided with longitudinal ridges 34 that run parallel to the axis 28 of the central portion 12. The ridges 36 may be formed on the inner surfaces 24 and 26 of the first and second arms. In other embodiments, the ridges may be formed on both the inner surfaces 24 and 26 and the outer surfaces 38 and 40 of the first and second arms. In one exemplary embodiment of the invention, the ridges have a height of 0.01 inch more or less and a depth of 0.04 inch more or less. The height and spacing of the ridges can be adjusted depending on the nature and surface conditions of particular objects with which the device will be used. For example, devices used to tie down stacks of cardboard boxes. Bricks, cardboard sheets, or metal sheets may use ridges of different dimensions.

Figure 4:
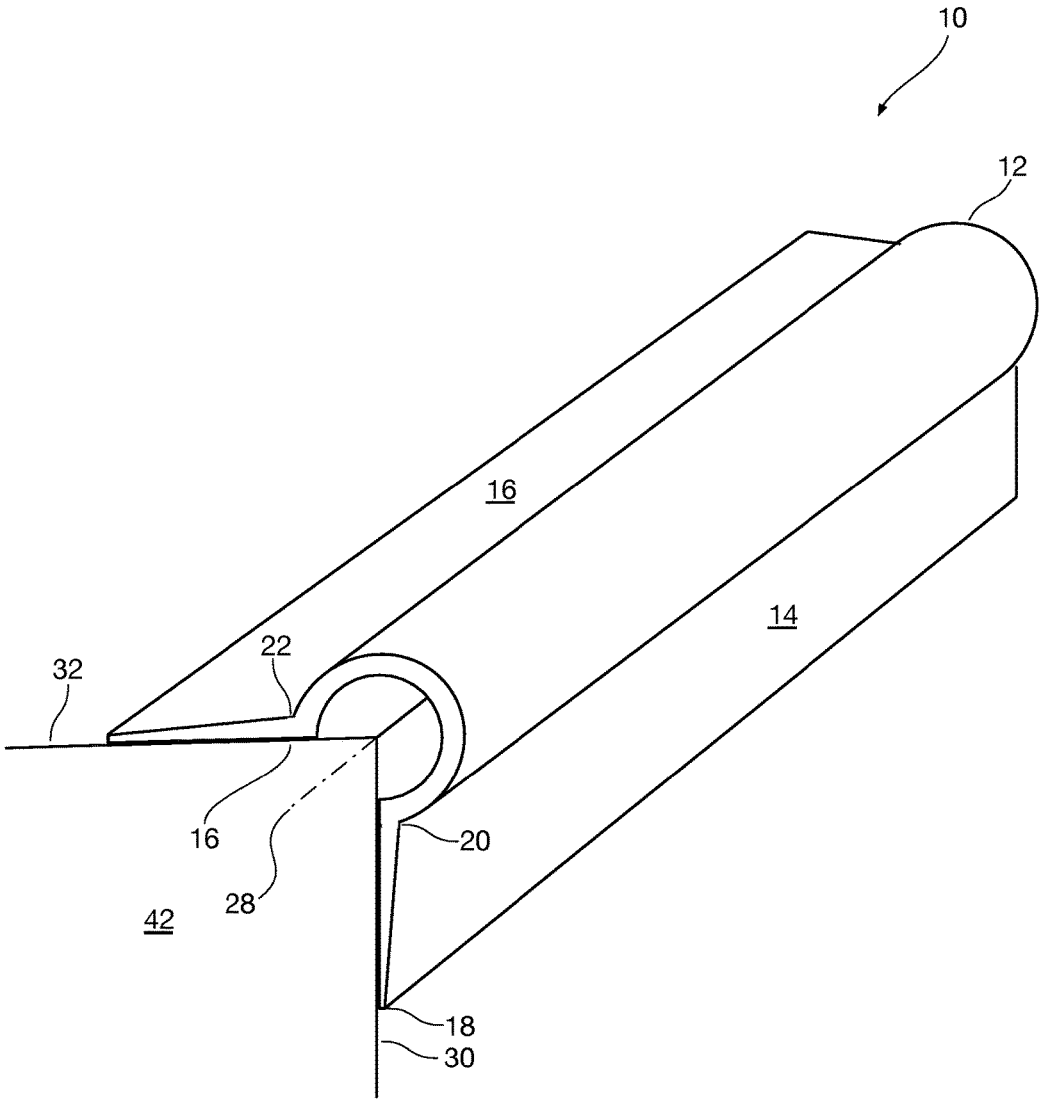
FIG. 4 is an isometric view of an exemplary protection device in accordance with the present invention showing a corner of an object being secured by the protection device.

Referring now to FIG. 4, an isometric view shows an exemplary protection device in accordance with the present invention showing a corner of an object 42 being secured by the protection device 10. Note that the corner 44 of the object 42 is in alignment with the longitudinal axis 28 of the central portion of the protection device 10. This assures that the protection device 10 is spaced apart from the edge separating the top of the object 42 from its side.

Although the above provides a full and complete disclosure of the preferred embodiments of the invention, various modifications, alternate constructions and equivalents will occur to those skilled in the art. Therefore, the above should not be construed as limiting the invention, which is defined by the claims.

What is claimed is:

1. A packaging corner protecting device for objects having edges with a generally right angular cross section, the device comprising:

(a) an arcuate center portion having a longitudinal axis, a length, a first thickness and formed as about 270° of a cylinder, (b) a first arm extending from the center portion and integrally joined to the center portion substantially the length of the center portion, the first arm having a proximate end at the center portion and an opposed distal end, the first arm having a cross section tapering from a first thickness at its proximate end to a second thickness at the distal end, the first thickness being greater than the second thickness, the first arm having an inner surface and an outer surface; and a second arm extending from the center portion and integrally joined to the center portion substantially the length of the center portion, the second arm having a proximate end at the center portion and an opposed distal end, the second arm having a cross section tapering from a first thickness at a proximate end to a second thickness at the distal end, the first thickness being greater than the second thickness the second arm having an inner surface and an outer surface;

wherein the inner surfaces of each arm lie in planes orthogonal to one another that intersect the longitudinal axis of the arcuate center portion, wherein the first arm and the second arm both extend the same distance from the center portion, the first arm and the second arm each include a plurality of longitudinal ridges on both the inner surfaces and outer surfaces thereof, and the device is made from a plastic material comprising high-density polyethylene.

2. The packaging corner protecting device of claim 1 wherein the first arm and the second arm each taper in thickness in a plurality of steps.

3. A combination comprising:

an object having a substantially flat top surface disposed orthogonally to a substantially flat side surface;

a packaging corner protecting device comprising:

(a) an arcuate center portion having a longitudinal axis, a length, a first thickness and formed as about 270° of a cylinder, (b) a first arm extending from the center portion and integrally joined to the center portion substantially the length of the center portion, the first arm having a proximate end at the center portion and an opposed distal end, the first arm having a cross section tapering from a first thickness at its proximate end to a second thickness at the distal end, the first thickness being greater than the second thickness, the first arm having an inner surface and an outer surface, the inner surface of the first arm lying substantially flat against the side surface of the object; and a second arm extending from the center portion and integrally joined to the center portion substantially the length of the center portion, the second arm having a proximate end at the center portion and an opposed distal end, the second arm having a cross section tapering from a first thickness at a proximate end to a second thickness at the distal end, the first thickness being greater than the second thickness the second arm having an inner surface and an outer surface, the inner surface of the second arm lying substantially flat against the side surface of the object;

wherein the inner surfaces of each arm lie in planes orthogonal to one another that intersect the longitudinal axis of the arcuate center portion, wherein the first arm and the second arm both extend the same distance from the center portion, the first arm and the second arm each include a plurality of longitudinal ridges on both the inner surfaces and outer surfaces thereof, and the device is made from a plastic material comprising high-density polyethylene.

4. The combination of claim 3, wherein the first arm and the second arm of the packaging corner protecting device each taper in thickness in a plurality of steps.

* * * * *